US007441422B2

(12) United States Patent
Choi

(10) Patent No.: US 7,441,422 B2
(45) Date of Patent: Oct. 28, 2008

(54) DRUM TYPE WASHING MACHINE WITH ROTATABLE BAFFLE

(75) Inventor: Seung-Bong Choi, Changwong-shi (KR)

(73) Assignee: LG Electronics Inc., Seoul (KR)

( * ) Notice: Subject to any disclaimer, the term of this patent is extended or adjusted under 35 U.S.C. 154(b) by 650 days.

(21) Appl. No.: 10/416,731

(22) PCT Filed: Nov. 15, 2001

(86) PCT No.: PCT/KR01/01949

§ 371 (c)(1),
(2), (4) Date: May 14, 2003

(87) PCT Pub. No.: WO02/40762

PCT Pub. Date: May 23, 2002

(65) Prior Publication Data

US 2004/0031295 A1 Feb. 19, 2004

(30) Foreign Application Priority Data

Nov. 17, 2000 (KR) ..... 2000-68454

(51) Int. Cl.
*D06F 37/06* (2006.01)

(52) U.S. Cl. ..... 68/58; 68/140; 366/225

(58) Field of Classification Search ..... 68/24, 68/58, 139, 140, 141, 142, 143, 144, 145, 68/146; 366/225, 229, 223, 221, 222
See application file for complete search history.

(56) References Cited

U.S. PATENT DOCUMENTS 54,622 A * 5/1866 Stanles ..... 366/223
1,375,522 A * 4/1921 Lombardi ..... 68/60
1,476,081 A * 12/1923 Kavanaugh ..... 68/60
2,320,488 A * 6/1943 Troy ..... 38/143
2,450,262 A * 9/1948 Winslow et al. ..... 474/2
2,517,857 A * 8/1950 Evans ..... 366/313
2,523,305 A * 9/1950 Johnson ..... 68/53
2,660,870 A * 12/1953 Kennedy ..... 68/24
2,911,810 A * 11/1959 Lantz et al. ..... 68/12.15
2,950,906 A * 8/1960 Hilkemeier ..... 366/44

(Continued)

FOREIGN PATENT DOCUMENTS

JP 1-292821 * 11/1989

(Continued)

OTHER PUBLICATIONS

Search Report from the European Patent Office dated Jun. 30, 2007.

*Primary Examiner*—Frankie L Stinson
(74) *Attorney, Agent, or Firm*—McKenna Long & Aldridge LLP

(57) ABSTRACT

Drum type washing machine with a rotatable baffle including a tub fitted in a cabinet, a drum in a tub to be rotatable as rotation force is received from a motor part, and the baffle fitted in the drum to be rotatable in a direction opposite to a direction of rotation of the drum, thereby enhancing a washing efficiency because the baffle increases a friction to the laundry as the baffle and the drum rotate in opposite directions, and improving a laundry drying performance because spun laundry is taken off from an inside surface of the drum before drying the laundry, and preventing formation of wrinkles on dried laundry.

23 Claims, 5 Drawing Sheets

U.S. PATENT DOCUMENTS

| | | | | | |
|---|---|---|---|---|---|
| 3,058,329 | A | * | 10/1962 | Searle | 68/23.6 |
| 3,060,764 | A | * | 10/1962 | Sibbald | 74/665 R |
| 3,682,398 | A | * | 8/1972 | Lamort | 241/46.17 |
| 4,572,674 | A | * | 2/1986 | Mathis et al. | 366/192 |
| 4,835,994 | A | * | 6/1989 | Ishida et al. | 68/174 |
| 4,856,867 | A | * | 8/1989 | Gaylin | 385/113 |
| 4,971,449 | A | * | 11/1990 | Hendren | 366/228 |
| 5,000,016 | A | * | 3/1991 | Burk et al. | 68/23.7 |
| 5,950,459 | A | * | 9/1999 | Takagi et al. | 68/23.6 |
| 6,212,722 | B1 | * | 4/2001 | Pinkowski et al. | 8/158 |

FOREIGN PATENT DOCUMENTS

| | | | |
|---|---|---|---|
| JP | 2-277493 | | 11/1990 |
| JP | 3-9787 | | 1/1991 |
| JP | 3-51080 | | 3/1991 |
| JP | 03-057490 | | 3/1991 |
| JP | 3-111089 | | 5/1991 |
| JP | 4-92697 | | 3/1992 |
| JP | 4-99590 | * | 3/1992 |
| JP | 8-206389 | | 8/1996 |
| JP | 9-266997 | | 10/1997 |
| JP | 10-033886 | | 2/1998 |
| JP | 11-276758 | * | 10/1999 |
| JP | 11-276778 | | 10/1999 |
| JP | 11-300086 | * | 11/1999 |
| JP | 2002-346271 | * | 12/2002 |
| KR | 10-1992-0010399 | | 11/1992 |
| KR | 2000-0009517 | | 6/2000 |
| WO | WO 99/58753 | | 11/1999 |

* cited by examiner

DRUM TYPE WASHING MACHINE WITH ROTATABLE BAFFLE

TECHNICAL FIELD

The present invention relates to a drum type washing machine, and more particularly, to a drum type washing machine with a baffle inside of a drum which is rotatable in a direction opposite to a rotational direction of the drum.

BACKGROUND ART

In general, the drum type washing machine, carrying out washing by using a friction force between a drum rotated as a driving power of a motor part is received, and laundry in a state detergent, washing water, and the laundry are introduced into the drum, gives little damage to the laundry, has little entangling of the laundry, and can provide a washing effect of pounding and rubbing the laundry.

FIG. 1 illustrates a side section of a related art drum type washing machine, and FIG. 2 illustrates a front section of FIG. 1.

Referring to FIG. 1, the related art drum type washing machine is provided with a cylindrical tub 2 in a cabinet 1, and a cylindrical drum 3 rotatably fitted in the tub 2. There is a driving shaft (not shown) having a fore end fixed to a spider (not shown) fixed to rear part of the drum 3, and a rear end passed through a central part of the tub 2, extended to an outside of the rear wall 2*a* of the tub 2, and coupled with a rotor (not shown) of a motor part 10. According to this, when a voltage is applied to a stator (not shown) in the motor part 10, the rotor in the motor part 10 rotates, and the driving shaft is rotated according to rotation of the rotor.

In the meantime, there are hanging springs 9 between an inside circumference of an upper part of the cabinet 1, and an outside circumference of an upper part of the tub 2 for supporting the tub 2, and there is a damper 8 between an inside circumference of a lower part of the cabinet 1 and an outside circumference of a lower part of the tub 2, for attenuating vibration of the tub 2 occurred in spinning.

In a case of a drum type washing machine having a drying function, the drum type washing machine is provided with a drying means additionally which has, as shown in FIG. 2, a duct with an end connected to one side of a lower part of the tub 2, and the other end extended upward and connected to the upper part of the tub 2. There is a drying heater 21 on the duct 25 extended to the upper side of the tub 2 for generating a drying heat, and there is a fan 22 for supplying the heat from the drying heater 21 into the drum 3.

The operation of the related art drum type washing machine will be explained.

Upon application of power to the motor part 10 after laundry, detergent, and washing water are introduced into the drum 3, the rotor rotates. According to the rotation of the rotor, the driving shaft rotates, and according to the rotation of the driving shaft, the drum 3 rotates. According to this, the laundry repeats cycling of rolling, and being lifted up to a certain height along an inside surface of the drum 3 by lifters 3*a* on the inside surface of the drum 3, and falling down, to make the washing done by a friction force between the laundry, the drum 3, and the lifters 3*a*. When the washing is finished, the drum 3 spins for extracting water in the laundry by using a centrifugal force from the spin. In the case of the drum type washing machine with a drying function, the drying heater 21 comes into operation after the spinning is finished, to generate heat, and the fan 22 is rotated, to supply heated air into the drum 3, for drying the laundry in the drum 3.

However, the related art washing machine has the following problems.

First, the related art drum type washing machine has an inadequate friction force applicable to the laundry, with a poor washing efficiency, and a long washing time period, because the related art drum type washing machine washes the laundry by applying friction to the laundry inside of the drum 3 by means of lifters 3*a* on an inside surface of the drum to move together with the drum 3.

Second, even if parts of the laundry are inserted in drain holes in the drum 3 by the centrifugal force when the spinning is finished, the related art drum tripe washing machine dries the laundry without taking out the laundry from the drain holes, but as the laundry is stuck to the wall surface of the drum 3. Consequently, since the heated air can not be blown to the laundry uniformly because the drying is conducted in a state the laundry is stuck to the wall surface of the drum 3, with wrinkles, or overlapped states, the drying performance is poor.

Third, the drying with wrinkles, or overlapped states of the laundry, there are the wrinkles after the drying is completed.

DISCLOSURE OF THE INVENTION

Accordingly, the present invention is directed to a drum type washing machine with a rotatable baffle that substantially obviates one or more of the problems due to limitations and disadvantages of the related art.

An object of the present invention is to provide a drum type washing machine with a rotatable baffle, in which a friction applied to laundry is increased for enhancing a washing efficiency.

Another object of the present invention is to provide a drum type washing machine with a rotatable baffle, in which drying is conducted after spun laundry is taken off from an inside surface of the drum, for prevention of formation of wrinkles on the laundry, and deterioration of drying performance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the drum type washing machine with a rotatable baffle includes a tub fitted in a cabinet, a drum in a tub to be rotatable as rotation force is received from a motor part, and the baffle fitted in the drum to be rotatable in a direction opposite to a direction of rotation of the drum.

The baffle in the drum fitted to be rotatable in a direction opposite to a direction of rotation of the drum for taking the laundry off an inside surface of the drum when a drying function is carried out in which spun laundry is dried by drying means at one side of inside of the cabinet.

Preferably, the drum type washing machine further includes a rotation force transmission device for rotating the baffle upon receiving the rotation force from the motor part including a gear box fixed inside of the gear box housing having opened fore end and rear end for allowing the inner, and outer drum shafts to pass therethrough, or be inserted therein, a sun gear fitted coaxially with a driving shaft for interlocked rotation with the driving shaft, a plurality of planetary gears for being rotated upon receiving rotation force from the sun gear, a shaft extension extended from the rear end of the drum shaft having an inner circumference with a gear part for engagement with the planetary gears, a carrier having a rotation shaft in front of a base, which is a rotation center of the planetary gears, and an extension in rear of the base positioned between the inner drum shaft and a rear opening in the gear box, first one way rotation means between an outside circumference of the driving shaft and an inside circumference of the drum shaft for permitting one way interlocked rotation of the inner, and outer drum shafts, and second one way rotation means between an inside circumference of the rear end opening in the gear box and an outside circumference of the extension of the carrier for permitting one way rotation of the carrier.

The baffle includes a circular rear face having a diameter smaller than a diameter of the rear wall of the drum, a plurality of lifters each elongated in a front direction parallel to an inside surface of the drum from the rear face, and a reinforcing rib part formed along a circumferential direction of the inside surface of the drum to connect the lifters.

Preferably, the reinforcing rib part includes at least one rib along a length of the lifter, and the reinforcing rib includes a surface aligned with a bottom surface of the lifter.

Preferably, the baffle is formed of plastic, by injection molding as one unit.

Preferably, the baffle is designed to rotate in a direction opposite to the drum in washing, and in the same direction with the drum in spinning, and the baffle is designed to rotate in the same direction with the drum in spinning, and in a direction opposite to the drum in washing, or drying.

The reinforcing rib preferably includes a plurality of projections in a radial direction.

As has been explained, the drum type washing machine of the present invention can enhance a washing efficiency because the baffle increases a friction to the laundry as the baffle and the drum rotate in opposite directions, improves a laundry drying performance because spun laundry is taken off from an inside surface of the drum before drying the laundry, and prevents formation of wrinkles on dried laundry.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
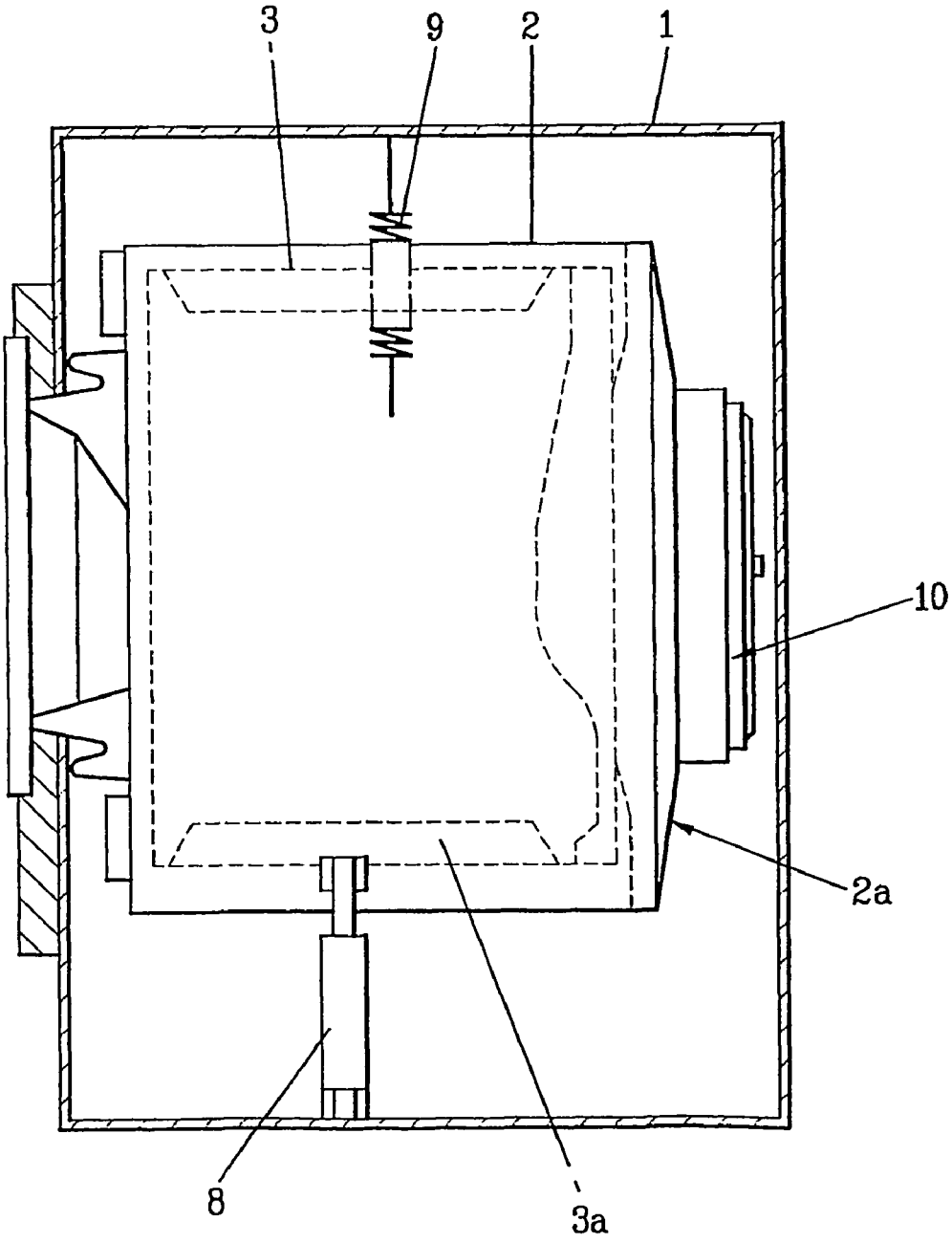
FIG. 1 illustrates a side section of a related art drum type washing machine.
Figure 2:
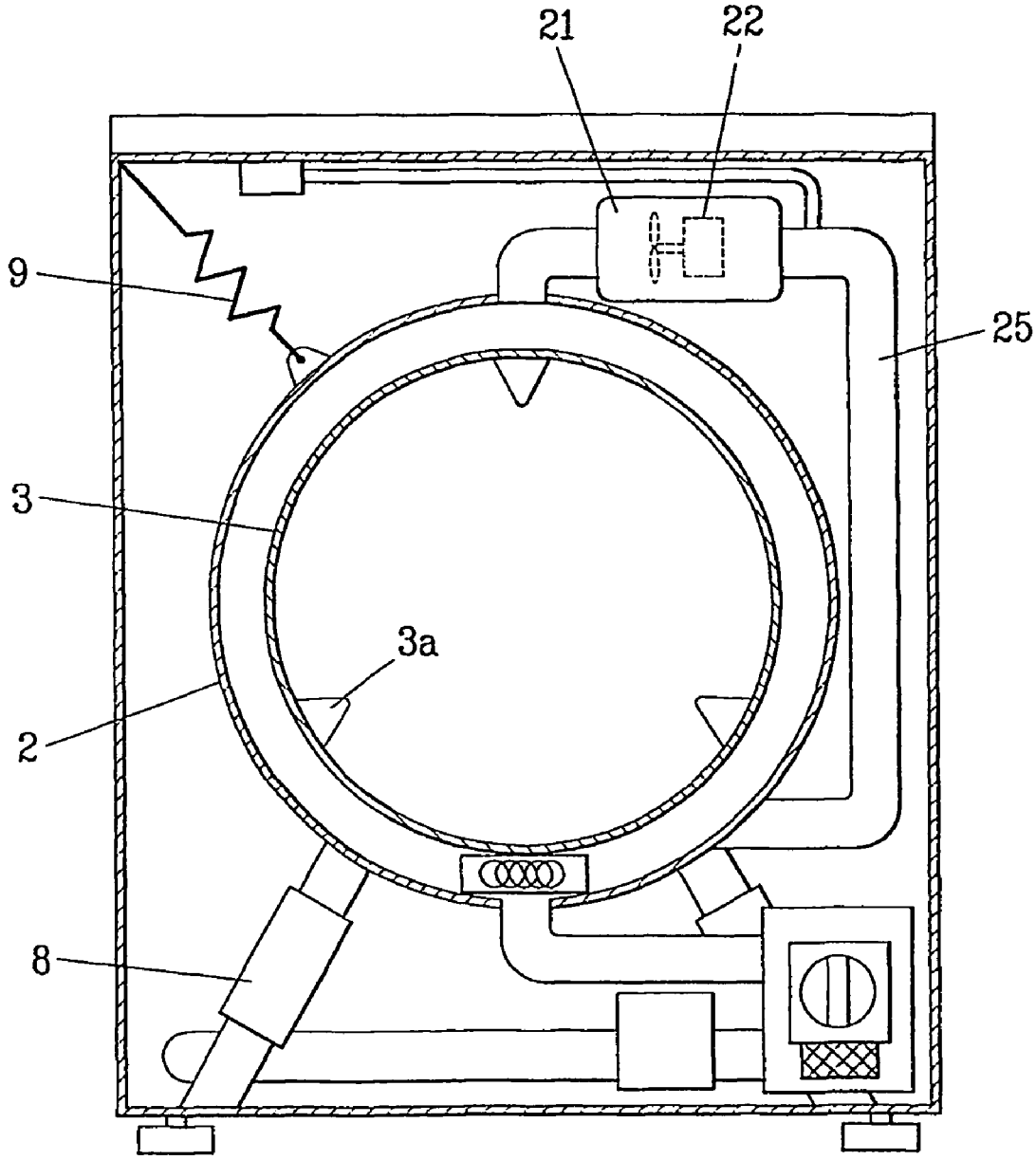
FIG. 2 illustrates a front section of FIG. 1.
Figure 3:
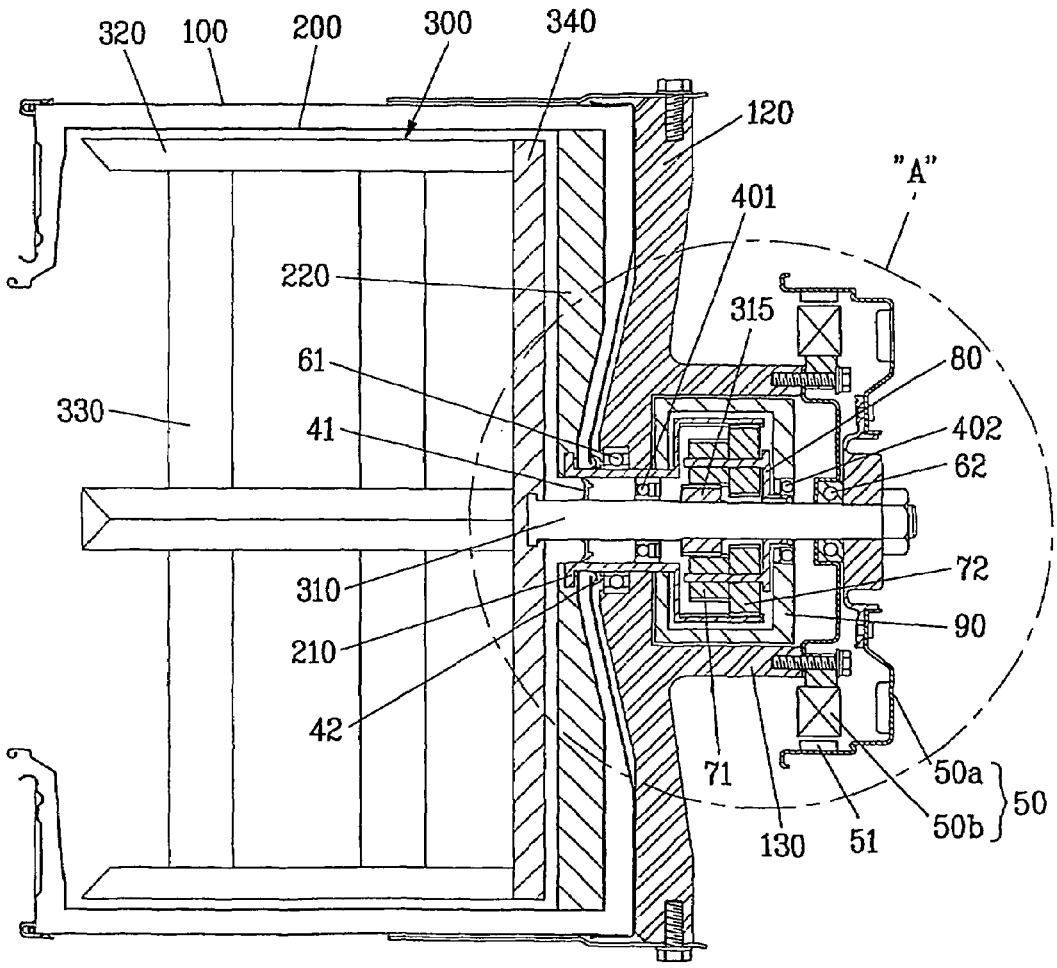
FIG. 3 illustrates a side section of a drum type washing machine in accordance with a preferred embodiment of the present invention.

Reference will now be made in detail to the preferred embodiments of the present invention, examples of which are illustrated in the accompanying drawings. For convenience of description, a left part on the drawing is taken as a front part of the drum type washing machine, and a right part on the drawing is taken as a rear part of the drum type washing machine. FIG. 3 illustrates a side section of a drum type washing machine in accordance with a preferred embodiment of the present invention, FIG. 4 illustrates a perspective view of a baffle in a drum type washing machine of the present invention, and FIG. 5 illustrates an enlarged view of "A" part in FIG. 3.

Referring to FIG. 3, the drum type washing machine in accordance with a preferred embodiment of the present invention includes a tub 100 in a cabinet, and a cylindrical drum 200 movably fitted in the tub 100 having an opening in a front part. There is a baffle 300 rotatably fitted inside of the drum 200, coaxial with the drum 200. The baffle 300 with a diameter smaller than the drum 200 has a rear face part 340 with a thickness, and a plurality of lifters 320 in front of the rear face part 340 extended parallel to an inside surface of the drum 200. The lifter 320 has a length shorter than an axial length of the drum 200.

Figure 4:
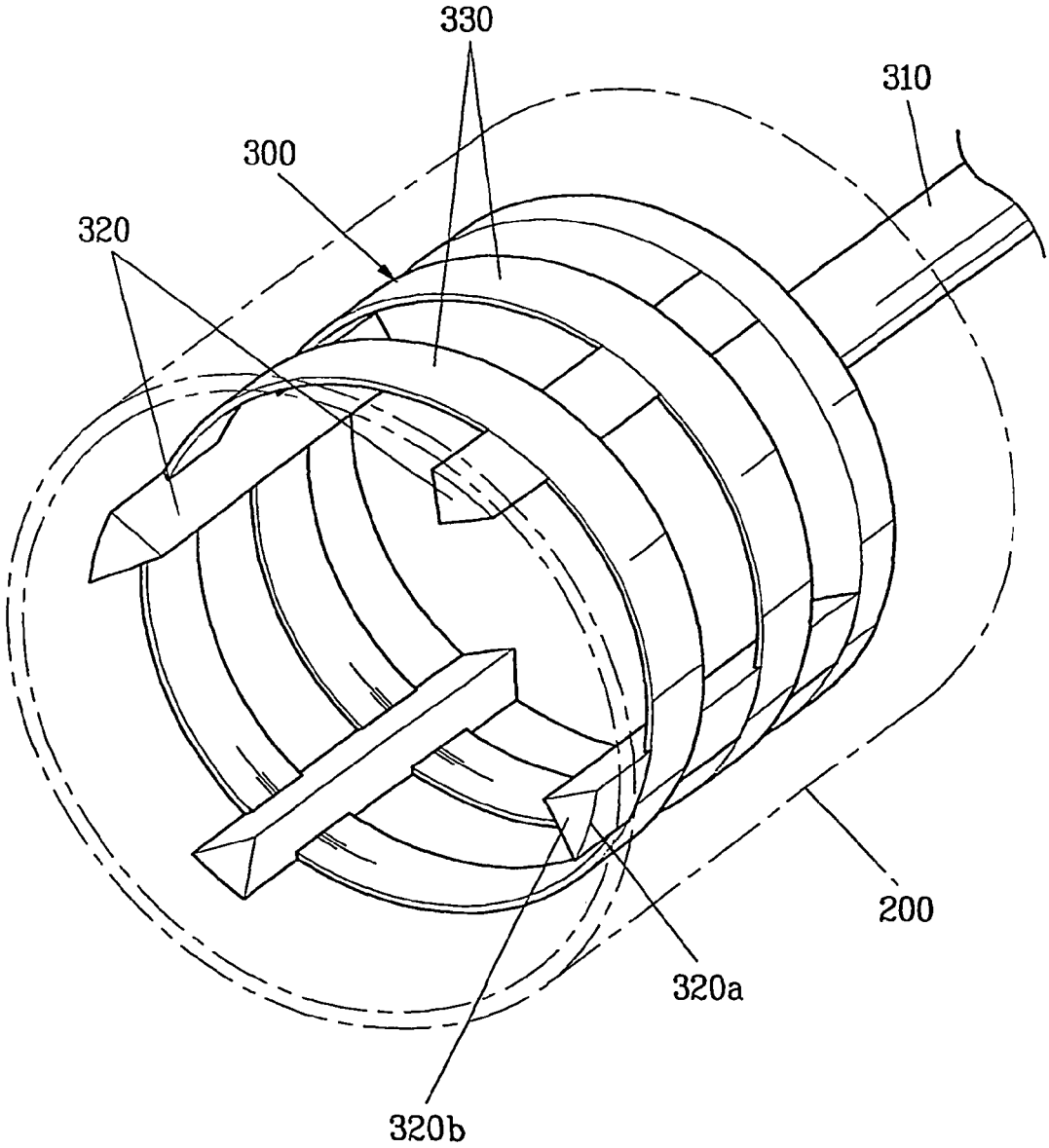
FIG. 4 illustrates a perspective view of a baffle in a drum type washing machine of the present invention; and, FIG. 5 illustrates an enlarged view of "A" part in FIG. 3.

Referring to FIG. 4, the lifter 320 has a triangular section, however, the section is not limited to triangle, but may be polygonal, or circular. The lifter 320 has a bottom **320*a* having a width greater than an upper part 320*b* projected in an inward radial direction. There are reinforcing ribs 330 between the lifters 320 along a circumferential direction of an inside surface of the drum 200 connecting the bottom 320*a* of the lifters 320 for enhancing a supporting force between the lifters 320. It is preferable that there are a plurality of inward projections (not shown) from the reinforcing ribs 330 for enhancing friction with the laundry. There are at least one reinforcing ribs 330 along a length direction of the lifter 320, with a bottom of the reinforcing rib 330 aligned with the bottom 320 of the lifter 320. The baffle 300 may be formed of a metal, or a plastic. When the baffle 300 is formed of plastic, the reinforcing rib 330, the rear face part 340, and the lifters 320 may be injection molded as one unit. It is preferable that the baffle 300** is formed of a material having a strong heat resistance, and a strong wear resistance.

Figure 5:
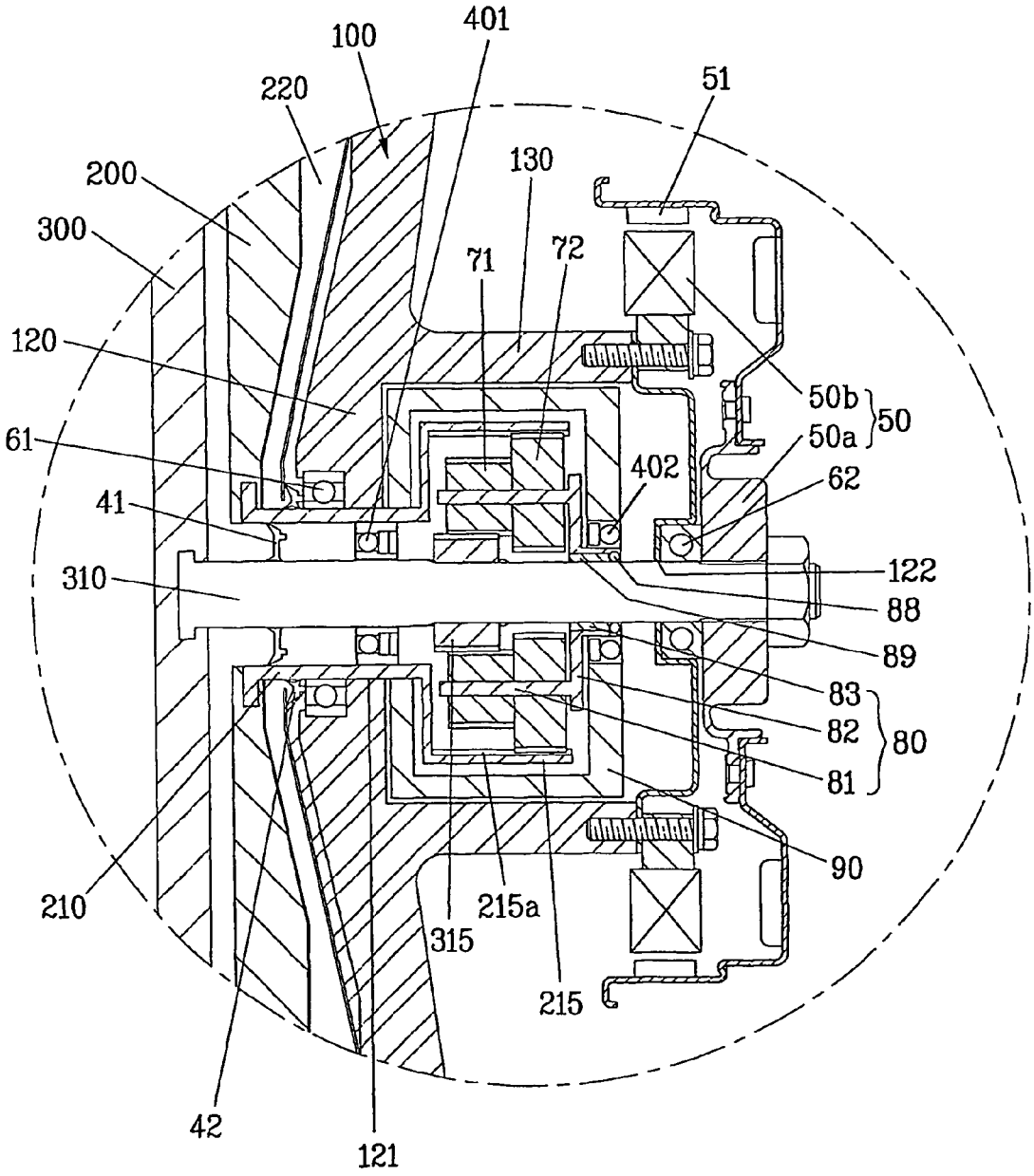

Referring to FIG. 5, there is a driving shaft 310 having a fore end fixed to a rear end of the baffle 300, and a rear end, passed through a central part of the rear wall 120 of the tub 100, and coupled to a rotor **50*a* of the motor part 50 in rear of the rear wall 120. There is a spider 220 fixed at a rear end of the drum 200, and a drum shaft 210 fixed at a central part of the spider 220. There is a gear box housing 130 extended from rear of a rear wall 120 of the tub 100 formed as a unit with the tub 100 having a cavity in which the drum shaft 210, and the driving shaft 310 are rotatably inserted. There is a cylindrical gear box 90 inside of the gear box housing 130**, having openings in front, and rear part.

The gear box housing 130 has a front through hole 121 in a central part of a front part of the gear box housing 130 (i.e., the rear wall 120 of the tub 100), and a rear through hole 122 in a central part of rear of the gear box housing 130 with a diameter enough to pass the driving shaft 310. There is a front bearing 61 in a front part of the front through hole 121, and a rear bearing 62 in a rear part of the rear through hole 122. In this instance, an inner lace of the front bearing 61 rotatably supports an outer circumference of the drum shaft 210, and an inner lace of the rear bearing 62 rotatably supports an outer circumference of the driving shaft 310.

As explained, the driving shaft 310 passes through the rear wall 120 of the tub 100, and is rotatably supported and takes rotation force of the motor part 50 in rear of the rear wall 120, which will be explained, in detail.

The driving shaft 310 passes through the rear through hole 122 of the gear box housing 130, and coupled with a rotor 50*a* in the motor part 50 by known fastening means, such as bolt, and the like, at a rear end thereof There is a stator 50*b* fitted to a rear end of the gear box housing 130, with magnets 51 of the rotor 50*a* designed to come opposite to the stator 50*b* in an outer side of the stator 50*b* in a radial direction, to form a motor part 50 for generating the rotating force by means of the rotor 50*a* and the stator 50*b*. Accordingly, upon application of power to the motor 50, the rotor 50*a* rotates in regular/reverse direction, to rotate the baffle 300 in regular/reverse direction too as the driving shaft 310 coupled to the rotor 50*a* rotates.

According to the drum type washing machine of the present invention, the baffle 300 and the drum 200 are designed to rotate in opposite directions (for an example, the baffle rotates in a clockwise direction, while the drum rotates in a counter clockwise direction) in washing, or drying, and to rotate in the same direction (for an example, both the baffle, and the drum rotate in the counter clockwise direction) in spinning. The opposite direction rotation of the baffle 300, and the drum 200 is implemented by the rotation force transmission device of the present invention, and the same direction rotation of the baffle 300, and the drum 200 is implemented by the first, and second one way rotation means 401, and 402, permitting a reverse direction rotation of the drum 200 with respect to a rotation direction of the baffle 300 in washing, or drying, and the same direction rotation of the baffle 300 and the drum 200 in spinning.

The rotation force transmission device in the drum type washing machine of the present invention will be explained.

The drum shaft 210 has a cylindrical shaft extension 215 extended from a rear end to inside of the gear box 90 in which there is a gear part 215*a*. The shaft extension 215 has a diameter greater than a diameter of the drum shaft 210, and smaller than a diameter of the gear box 90. There is a sun gear 315 coaxial to the driving shaft 310 for rotation together with the driving shaft 310. There are a plurality of planetary gears 71, and 72 for taking, and being rotated by a rotation force of the sun gear 315, each of which planetary gears 71, and 72 has two gears fitted coaxially as one unit, with different radiuses, and number of teeth. The planetary gears 71, and 72 are supported on respective rotation shafts 81 on a base 82 of a carrier 80, and engaged with the gear part 215*a* on the shaft extension 215, for transmission of a rotation force of the sun gear 315 to the drum shaft 210. There is an extension 83 from rear of the base 82 extended to a rear direction between the driving shaft 310 and the rear end opening of the gear box 90, with a gap between the extension 83 and the outer circumference of the driving shaft 310. There is an oiless bearing 89 and sealing means 88 between an inner circumference of the extension 83 and the outer circumference of the driving shaft 310 in succession for making a space between the extension 83 and the driving shaft 310 air tight. On the other hand, there is sealing means 41 between the inner circumference of the drum shaft 210, and the outer circumference of the driving shaft 310 for preventing leakage of water to the gear box 90. Also, There is sealing means 42 between the outer circumference of the drum shaft 210 and the spider 220 in rear of the drum 200 for preventing leakage of water to the front bearing 61.

There are two planetary gears 71, and 72 on the shaft 81 of the carrier 80 having different radiuses and numbers of teeth, for an appropriate adjustment of a rotation speed of the baffle 300 and the drum 200 by an appropriate change of the radiuses and the numbers of gear teeth. That is, an appropriate adjustment of a rotation ratio of the baffle 300 and the drum 200 facilitates an enhancement of the washing efficiency.

It can be known that, as has been explained, because the rotation force is transmitted to the drum shaft 210 by the rotation force transmission device in a case the driving shaft 310 rotates, the driving shaft 310 and the drum shaft 210 rotate in opposite directions, that implements the opposite direction rotation of the baffle 300 and the drum 200.

First, and second one way rotation means will be explained.

There is the first one way rotation means 401 between the outer circumference of the driving shaft 310 and the inner circumference of the drum shaft 210 for one way interlocked rotation of the inner, and drum shafts 310, and 210. There is the second one way rotation means 402 between the inner circumference of the rear end opening of the gear box 90, and the outer circumference of the extension 83 of the carrier 80 for one way rotation of the carrier 80. That is, the first, and second one way rotation means 401, and 402 may be, for an example, one way bearings, for, as an example, rotating the drum 200 in the clockwise direction by rotating the driving shaft 310 in the counter clockwise direction, that rotates the baffle 300 in the counter clockwise direction, which will be explained, in detail.

The inner lace of the first one way rotation means 401 held on an outer circumference of the driving shaft 310 is fitted such that clockwise rotation of the driving shaft 310 is permitted, while counter clockwise rotation of the driving shaft 310 is not permitted, to make interlocked rotation of the drum shaft 210 and the driving shaft 310 by restriction of the first one way rotating means 401 when the rotor 50*a* is rotated in the counter clockwise direction. As has been explained, when both the driving shaft 210, and the drum shaft 310 are rotated in the counter clockwise direction, both the sun gear 315 on the driving shaft 310 and the planetary gears 71, and 72 engaged with the gear part 215*a* of the shaft extension 215 are remained stationary. Accordingly, the carrier 80 is also rotated in the counter clockwise direction interlocked with the inner, and drum shafts 310, and 210.

In the meantime, the second one way rotation means 402 permits an interlocked rotation of the carrier 80 in a direction opposite to the interlocked rotation direction of the driving shaft 310 and the drum shaft 210 that the first one way rotation means 401 permits. That is, under a state all the driving shaft 310, the drum shaft 210, and the carrier 80 make interlocked counter clockwise direction rotation, the second one way rotation means 402 is fitted not to restrict the rotation in the rotation direction (counter clockwise direction) of the carrier 80. The second one way rotation means 402 is fitted to restrict clockwise rotation of the carrier 80 under the following reason. When the rotor 50*a* rotates in the clockwise direction, the driving shaft 310 and the drum shaft 210 rotate in opposite directions, to rotate the carrier 80 in a direction the same with the driving shaft 310. In this instance, if the rotation of the carrier 80 is restricted, the rotation force of the drum shaft 210 can be maintained, more positively. From the foregoing description, it can be known that, when the rotor 50*a* rotates in the counter clockwise direction, both the driving shaft 310 and the drum shaft 210 rotate in the same direction, to make the baffle 300 and the drum 200 to rotate in the same direction.

The drum type washing machine of the present invention may be employed in a washing machine with, or without a drying function, which will be explained in more detail. That is, setting of rotation direction of the rotor 50*a* may be made differ by a control part in washing, spinning, and drying, depending on employment of the drying function.

When the drum type washing machine of the present invention is employed in a washing machine without the drying function, the rotation direction of the rotor 50*a* is set to be the clockwise direction by the control part in washing. In this instance, the baffle 300 and the drum 200 rotate in opposite directions in washing (for an example, the baffle rotates in a clockwise direction, while the drum rotates in a counter clockwise direction). In spinning, the rotation direction of the rotor 50*a* is set to be the counter clockwise direction, and to rotate at a regular rotation speed for spinning. In spinning, the baffle 300 and the drum 200 rotate in the same direction (for an example, both the baffle and the drum rotate in the counter clockwise direction). By setting the rotation direction of the rotor 50*a* thus, washing is made while the drum 200 and the baffle 300 rotate in opposite directions, and spinning is made while the drum 200 and the baffle 300 rotate in the same direction.

On the other hand, when the drum type washing machine of the present invention is employed in a washing machine with the drying function, the rotation direction of the rotor 50*a* is set to be the counter clockwise direction by the control part in spinning so that the spinning is made as the drum 200 and the baffle 300 rotate in the same direction. In this instance, the rotation speed of the rotor 50*a* in the spinning is set to be a regular spinning speed. In washing, or drying, the rotation direction is set to be the clockwise direction by the control part, to rotate the baffle 300 and the drum 200 in opposite directions. Eventually, in spinning, the rotation directions of the baffle 300 and the drum 200 are the same while the rotation directions of the drum 200 and the baffle 300 are opposite in washing, or drying.

It will be apparent to those skilled in the art that various modifications and variations can be made in the drum type washing machine with a rotatable baffle of the present invention without departing from the spirit or scope of the invention. Thus, it is intended that the present invention cover the modifications and variations of this invention provided they come within the scope of the appended claims and their equivalents.

INDUSTRIAL APPLICABILITY

As has been explained, the drum type washing machine, provided with a baffle inside of a drum rotatable opposite to the drum, can enhance a washing efficiency because the baffle increases a friction to the laundry as the baffle and the drum rotate in opposite directions in a case of drum type washing machine without a drying function. In a case of drum type washing machine with a drying function, a laundry drying performance is improved because spun laundry is taken off from an inside surface of the drum before drying the laundry. Moreover, formation of wrinkles on dried laundry is prevented.

What is claimed is:

1. A drum type washing machine with a rotatable baffle comprising:

a tub fitted in a cabinet;

a drum in a tub to be rotatable as rotation force is received from a motor part; and the baffle fitted in the drum to be rotatable in a direction opposite to a direction of rotation of the drum and rotatable in the direction of rotation of the drum, wherein the baffle comprises:

a plurality of lifters, each lifter elongated along an axis parallel to a rotation axis of the drum; and a reinforcing rib part formed along a circumferential direction of the inside surface of the drum to connect the lifters.

2. The drum type washing machine as claimed in claim 1, wherein the baffle is fitted in the drum to be rotatable in the direction opposite to the direction of rotation of the drum for taking a laundry off an inside surface of the drum when a drying function is carried out in which the laundry is dried.

3. The drum type washing machine as claimed in claim 1, further comprising a rotation force transmission device which rotates the baffle in a direction opposite to a rotational direction of the drum or in the rotational direction of the drum upon receiving the rotation force from the motor part.

4. The drum type washing machine as claimed in claim 3, wherein the rotation force transmission device includes:

a gear box fixed inside of the gear box housing having opened fore end and rear end for allowing the inner, and outer drum shafts to pass therethrough, or be inserted therein, a sun gear fitted coaxially with a driving shaft for interlocked rotation with the driving shaft, a plurality of planetary gears for being rotated upon receiving rotation force from the sun gear, a shaft extension extended from the rear end of the drum shaft having an inner circumference with a gear part for engagement with the planetary gears, a carrier having a rotation shaft in front of a base, which is a rotation center of the planetary gears, and an extension in rear of the base positioned between the inner drum shaft and a rear opening in the gear box, first one way rotation means between an outside circumference of the driving shaft and an inside circumference of the drum shaft for permitting one way interlocked rotation of the inner, and outer drum shafts, and second one way rotation means between an inside circumference of the rear end opening in the gear box and an outside circumference of the extension of the carrier for permitting one way rotation of the carrier.

5. The drum type washing machine as claimed in claim 1, wherein the baffle further includes:

a circular rear face disposed in the drum.

6. The drum type washing machine as claimed in claim 1, wherein the reinforcing rib part includes at least one rib along a length of the lifter.

7. The drum type washing machine as claimed in claim 1, wherein the reinforcing rib includes a surface aligned with a bottom surface of the lifter.

8. The drum type washing machine as claimed in claim 1, wherein the baffle is formed of plastic.

9. The drum type washing machine as claimed in claim 8, wherein the baffle is injection molded as one unit.

10. The drum type washing machine as claimed in claim 1, wherein the baffle rotates in a direction opposite to the drum in washing and in the same direction with the drum in water-extracting.

11. The drum type washing machine as claimed in claim 1, wherein the baffle rotates in the same direction with the drum in water-extracting, and in a direction opposite to the drum in washing and drying.

12. The drum type washing machine as claimed in claim 1, wherein the reinforcing rib includes a plurality of projections in a radial direction.

13. The drum type washing machine as claimed in claim 1, wherein the baffle rotates simultaneously with the drum.

14. The drum type washing machine as claimed in claim 1, further comprising a drying device providing a hot air to the drum.

15. The drum type washing machine as claimed in claim 1, wherein the baffle is rotated directly by a rotation force transmission device, in a direction opposite to a rotational direction of the drum or in the rotational direction of the drum.

16. A front loading washing machine comprising:

a tub fitted in a cabinet of the front loading washing machine;

a drum positioned in the tub;

a rotatable baffle positioned within the drum, the rotatable baffle comprises:

a plurality of lifters extending along axes parallel to a central axis of the drum; and a rib extending along a circumferential direction and connecting the plurality of lifters; and a rotation force transmission device, wherein the rotation force transmission device rotates the baffle and the drum in the same direction and the rotation force transmission device rotates the baffle and the drum in opposite directions.

17. The front loading washing machine as claimed in claim 16, wherein the rotation force transmission device rotates the baffle and the drum simultaneously.

18. The front loading washing machine as claimed in claim 16, wherein the plurality of lifters are connected to each other.

19. The front loading washing machine as claimed in claim 16, wherein the rotatable baffle further comprises a disc coupled to rear ends of lifters.

20. The front loading washing machine as claimed in claim 19, wherein the disc is directly connected to a motor via a driving shaft.

21. The front loading washing machine as claimed in claim 16, further comprising a drying device providing a hot air to the drum.

22. The front loading washing machine as claimed in claim 16, wherein the rotation force transmission device rotates the baffle and the drum in the same direction during a water extracting cycle.

23. The front loading washing machine as claimed in claim 16, wherein the rotation force transmission device rotates the baffle and the drum in opposite directions during a washing cycle and a drying cycle.

* * * * *